US012258766B2

(12) United States Patent
Schoch

(10) Patent No.: US 12,258,766 B2
(45) Date of Patent: Mar. 25, 2025

(54) LOCKING CONNECTION ASSEMBLY AND MOUNTING METHOD

(71) Applicant: Elkamet Kunststofftechnik GmbH, Biedenkopf (DE)

(72) Inventor: Andreas Schoch, Marburg (DE)

(73) Assignee: ELKAMET KUNSTSTOFFTECHNIK GMBH, Biedenkopf (DE)

( * ) Notice: Subject to any disclaimer, the term of this patent is extended or adjusted under 35 U.S.C. 154(b) by 301 days.

(21) Appl. No.: 17/779,138

(22) PCT Filed: Nov. 26, 2020

(86) PCT No.: PCT/DE2020/101001
§ 371 (c)(1),
(2) Date: May 24, 2022

(87) PCT Pub. No.: WO2021/104578
PCT Pub. Date: Jun. 3, 2021

(65) Prior Publication Data

US 2022/0412100 A1 Dec. 29, 2022

(30) Foreign Application Priority Data

Nov. 29, 2019 (DE) ..... 10 2019 008 336.9

(51) Int. Cl.
*E04F 19/06* (2006.01)
*E04F 15/02* (2006.01)

(52) U.S. Cl.
CPC .. *E04F 15/02011* (2013.01); *E04F 15/02038* (2013.01); *E04F 19/062* (2013.01);
(Continued)

(58) Field of Classification Search
CPC ..... E04F 15/02011; E04F 15/02038; E04F 19/062; E04F 2201/0146;
(Continued)

(56) References Cited

U.S. PATENT DOCUMENTS 1,357,713 A * 11/1920 Lane ..... E04B 1/6803 404/69
2,427,937 A * 9/1947 Willson ..... E04B 1/34315 160/90

(Continued)

FOREIGN PATENT DOCUMENTS

DE 3638048 A1 5/1988
DE 3806091 A1 9/1989

(Continued)

*Primary Examiner* — Brent W Herring
(74) *Attorney, Agent, or Firm* — LEYDIG, VOIT & MAYER, LTD.

(57) ABSTRACT

A snap-fit connection arrangement includes groove and tongue strips respectively having a groove and tongue, and first and second attachment regions for placement along first and second components, respectively. The groove and tongue strips respectively extend in first and second longitudinal directions transversely to their respective cross sections. Cross-sectional contours of the tongue and the groove correspond to each other through use of latching elements so that a snap-fit connection can be established as the tongue is inserted in a joining direction into the groove. The snap-fit connection allows for relative movement between the tongue and groove strips along at least one of the longitudinal directions and prevents relative movement between the tongue and groove strips transversely to at least one of the longitudinal directions. The tongue includes a latching recess comprising an undercut that extends along and within the tongue and is configured for latching engagement with a rib.

31 Claims, 11 Drawing Sheets

(52) U.S. Cl.
CPC ..... *E04F 2201/0115* (2013.01); *E04F 2201/0146* (2013.01); *E04F 2201/0511* (2013.01); *E04F 2201/0517* (2013.01); *E04F 2201/0523* (2013.01); *E04F 2201/0535* (2013.01)

(58) Field of Classification Search
CPC ..... E04F 2201/0511; E04F 2201/0517; E04F 2201/0523; E04F 2201/0535; E04F 2201/0115
USPC ..... 52/395, 402, 396.1, 586.2, 578, 396.04
See application file for complete search history.

(56) References Cited

U.S. PATENT DOCUMENTS

| | | | | |
|---|---|---|---|---|
| 3,310,919 | A * | 3/1967 | Bue | E04F 15/02 52/591.1 |
| 6,769,835 | B2 * | 8/2004 | Stridsman | E04F 15/02 52/392 |
| 11,034,224 | B2 * | 6/2021 | Bergmann | B60J 10/70 |
| 11,131,102 | B1 * | 9/2021 | Hendifar | E04F 15/10 |
| 11,293,191 | B1 * | 4/2022 | Hendifar | E04F 15/02038 |
| 2002/0059764 | A1 * | 5/2002 | Schluter | E04F 15/02027 52/468 |
| 2003/0180091 | A1 * | 9/2003 | Stridsman | E04F 15/02 404/41 |
| 2004/0068954 | A1 | 4/2004 | Martensson | |
| 2009/0229212 | A1 * | 9/2009 | Sorini | E04F 15/02 52/586.2 |
| 2017/0226752 | A1 * | 8/2017 | Tsai | E04F 15/02194 |
| 2019/0160928 | A1 * | 5/2019 | Bergmann | B60J 10/70 |

FOREIGN PATENT DOCUMENTS

| | | | |
|---|---|---|---|
| DE | 29508974 | U1 | 8/1995 |
| DE | 29924454 | U1 | 5/2003 |
| DE | 202012102874 | U1 | 4/2013 |
| EP | 0214643 | A2 | 3/1987 |
| JP | 2008082648 | A | 4/2008 |
| WO | WO 0020706 | A1 | 4/2000 |
| WO | WO 0198604 | A1 | 12/2001 |

* cited by examiner

LOCKING CONNECTION ASSEMBLY AND MOUNTING METHOD

This application is a U.S. National Phase application under 35 U.S.C. § 371 of International Application No. PCT/DE2020/101001, filed on Nov. 26, 2020, and claims benefit to German Patent Application No. DE 10 2019 008 336.9, filed on Nov. 29, 2019. The International Application was published in German on Jun. 3, 2021 as WO 2021/104578 A1 under PCT Article 21(2).

FIELD

The present invention relates to a snap-fit connection arrangement for connecting components, as well as to a component, a structural body, and an assembly method.

The field of application of the solution provided in accordance with the invention covers all conceivable tasks where at least two components are connected together, in particular planar elements, such as floor elements, facade elements, roof elements, vehicle components, privacy screen elements, and the like. Also possible is a combination of a planar element with other commercially available components, such as profile elements, strip elements, frame elements, rod elements, and the like.

BACKGROUND

For purposes of establishing connections between planar elements, it is known to use, for example, so-called tongue-and-groove joints, such as are shown in EP 021 464 3 A2. However, such tongue-and-groove joints have the disadvantage that the connection can become loose very easily under certain conditions, for example during assembly and alignment, when a force acts on the components in a direction opposite to the joining direction.

To counteract this, latching connections have been developed. Document DE 299 24 454 U1, for example, discloses an approach where floor panels are interlocked along their end-face edges in the vertical direction by one or more projections at the end face of one panel, which are latched into corresponding recesses of the other panel. The approach known from DE 38 06 091 A1 refers to a structural body assembled from two or more profile strips, with a tongue-and-groove joint formed between each two adjacent profile strips. One strip is provided with a continuous longitudinally extending groove, and the other strip is provided with a continuous longitudinally extending rib engaging in the groove.

SUMMARY

In an embodiment, the present invention provides a snap-fit connection arrangement comprising a groove strip and a tongue strip. The groove strip has a groove and a first attachment region extending along the groove for placement of the groove along a first component. The groove strip extends in a first longitudinal direction transversely to a cross section of the groove strip. The tongue strip has a tongue and a second attachment region extending along the tongue for placement of the tongue along a second component. The tongue strip extends in a second longitudinal direction transversely to a cross section of the tongue strip. Cross-sectional contours of the tongue and the groove correspond to each other through use of latching elements so that a snap-fit connection can be established between the tongue and the groove as the tongue is inserted in a joining direction into the groove. The snap-fit connection allows for relative movement between the tongue strip and the groove strip along at least one of the longitudinal directions and prevents relative movement between the tongue strip and the groove strip transversely to at least one of the longitudinal directions. The first and second attachment regions lie in a common plane or in two different planes that intersect each other. The tongue includes a latching recess comprising an undercut that extends along and within the tongue and is configured for latching engagement with a rib of a rib strip.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
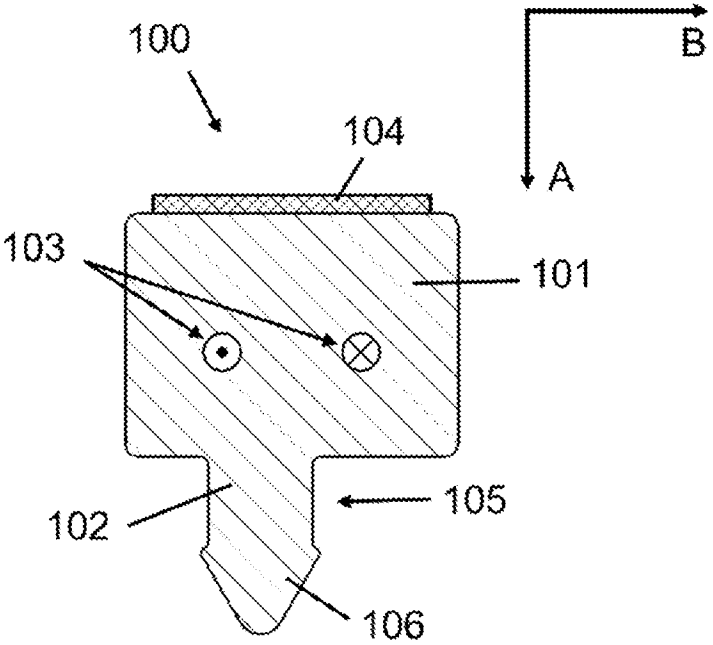
FIG. 1 is a cross-sectional view of a rib strip made of plastic.

It is desirable to have available alternative, universally usable solutions that provide maximum flexibility. The components should be able to be assembled and aligned with ease and as accurately as possible during the assembly process.

In accordance with embodiments of the invention, there is provided a snap-fit connection arrangement, a component, a structural body, and an assembly method. A component is understood to be any body capable of being connected to at least one further body of the same or different construction, each of the bodies having at least a front side and a back side as well as several end faces at which a strip can be disposed.

The inventive snap-fit connection arrangement according to an embodiment of the invention includes a groove strip (i.e., a first strip with a groove) having a first attachment region, which preferably extends immediately adjacent and parallel to the groove; i.e., along the groove. The groove serves to receive the tongue of a tongue strip, which will be described further below. The attachment region is used for the placement of the groove strip along a peripheral portion of a component so that the groove ideally extends along the edge of the component and adjacent to the component surface in such a manner that it is easily accessible. The component may be a cuboid shaped component, preferably a planar element such as a sheet, a panel, a cladding, a plate, a lath and/or a strip, a roof, wall or floor element, a solar panel, or the like. The groove strip extends in a first longitudinal direction, preferably transversely, particularly perpendicularly, to the cross section of the groove strip, and also in a first transverse direction.

The longitudinal extent (i.e., strip length in the longitudinal direction) of the groove strip may be many times greater than the transverse extent (i.e., strip width in the transverse direction, in particular perpendicular to the longitudinal direction), so that the typical character of a strip is obtained. To implement spot-type connections, the longitudinal extent may be approximately equal to, and possibly less than, the transverse extent. In particular, to implement spot-type connections, the longitudinal extent or the transverse extent may also correspond to the diameter of a circle. This is particularly the case if the contour of the groove strip extends approximately circularly as viewed in the joining direction from a plan view. Square, oval or other suitable contours are also conceivable as long as the latching engageability with the tongue strip described below is ensured.

The inventive snap-fit connection arrangement further includes a tongue strip (i.e., a second strip with a tongue) having a second attachment region, which preferably extends immediately adjacent and parallel to the tongue; i.e., along the tongue. The tongue is intended for insertion into the groove of the above-described groove strip. The attachment region is used for the placement of the tongue strip along a peripheral portion of a component so that the tongue ideally extends along the edge of the component and adjacent to the component surface in such a manner that it is easily accessible. The tongue strip extends in a second longitudinal direction, preferably transversely, particularly perpendicularly, to the cross section of the tongue strip, and also in a second transverse direction. The longitudinal extent of the tongue strip may also be many times greater than the transverse extent, so that the typical character of a strip is obtained. However, to implement spot-type connections, the length of the tongue strip may also be approximately equal to or less than the width of the cross section of the tongue strip. In particular, to implement spot-type connections, the longitudinal extent or the transverse extent may also correspond to the diameter of a circle. This is particularly the case if the contour of the tongue strip extends approximately circularly as viewed in the joining direction from a plan view. Square, oval or other suitable contours are also conceivable as long as the latching engageability with the above-described groove strip is ensured.

In summary, the following preferably holds for spot-type connections within the limits of typical manufacturing tolerances for the groove strip and/or the tongue strip:

$$\frac{\text{longitudinal extent}}{\text{transverse extent}} \sim 1$$

and for all other; i.e., non-spot-type connections, it preferably holds that:

$$\frac{\text{longitudinal extent}}{\text{transverse extent}} \gg 1$$

In this connection, it should be appreciated that the stability of the connection changes proportionally to the longitudinal extent, and that in order to meet the requirement of a very high stability, it may therefore be necessary to provide either a multiplicity of spot-type connections and/or non-spot-type connections or a combination of spot-type and non-spot-type connections, depending on the particular task.

According to an embodiment of the invention, the contours of the cross sections of the tongue and the groove are configured to correspond to each other through the use of latching elements (e.g., latching projections and/or latching recesses) for connecting the tongue strip to the groove strip preferably perpendicularly with respect to the longitudinal directions, so that a snap-fit connection, preferably a forced snap-fit connection, can be established between the groove strip and the tongue strip, depending on the insertion depth of the tongue into the groove as measured from the top edge of the groove opening. The term "snap-fit connection" is also understood to mean, inter alia, that the tongue automatically snaps into place within the groove by means of a latching operation when the tongue is inserted into the groove in the joining direction, a joining force is simultaneously applied in the joining direction, and the predetermined insertion depth is reached. The latching elements are preferably configured and matched to one another such that during assembly, the tongue can be inserted into the groove in the joining direction and latchingly engages automatically with the groove strip upon reaching the end position. In addition, the latching elements are preferably configured and matched to one another such that after the insertion depth is reached, movement in a direction opposite to the joining direction is hardly possible anymore; i.e., the groove strip and the tongue strip are fixed in position transverse to their longitudinal directions. For this purpose, the latching elements may preferably have a barb-like shape.

After the groove strip and the tongue strip are latched together, they still remain connected to each other in a releasable manner. The snap-fit connection arrangement according to an embodiment of the invention permits relative movement of the tongue strip with respect to the groove strip or relative movement of the groove strip with respect to the tongue strip along one of the two longitudinal directions of the strips. To release the connection, a much higher force is required than that required to establish the connection. After the snap-fit connection is established, the attachment regions of the strips lie in a common plane or in two different planes that intersect each other at an angle between greater than 0 and less than +/−180 degrees. In the first case, namely, the common plane, the two attachment regions form a common attachment plane that is horizontal with respect to the joining plane defined by the joining direction and a longitudinal direction. In the second case, the two attachment regions form attachment planes which may each be formed at an angle other than 90 degrees with respect to the joining plane.

The minimum size of the groove strip and/or the tongue strip depends in particular on the releasing forces that a snap-fit connection arrangement according to an embodiment of the invention is desired to withstand, as well as on the production method and the typical tolerance levels. Conceivable applications include both miniature applications with low stability requirements, for example in model making, as well as applications with very high stability requirements, for example in building construction or in civil engineering.

The groove strip and/or the tongue strip are/is advantageously made from a plastic material (e.g., PA 6 or PA 6.6) by extruding this plastic material in an extrusion process as a continuous length which may be cut into sections to obtain the desired longitudinal extent. Additional materials (e.g., metals, plastics, natural materials, etc.) may be incorporated by co-extrusion during the extrusion process in order to, for example, influence stability and flexibility, and to open up further fields of application. This allows the strips to be custom-made or manufactured very economically as a standard product and offered on the market at a correspondingly low price.

In its basic principle, an embodiment of the invention operates with at least two interlocking profile strips, namely the groove strip and the tongue strip. When creating the snap-fit connection arrangement according to an embodiment of the invention, the two profile strips latchingly engage with one another in a stable manner in the joining direction, so that they can still be manually separated from one another, but preferably only by exerting a clearly measurable greater amount of force than is required for assembly. This allows components to be preliminarily fixed transversely or perpendicularly to the longitudinal axes of the strips, which significantly simplifies the handling of an arrangement of components connected in accordance with an embodiment of the invention, and at the same time allows the components to be adjusted in the longitudinal direction even after the connection is established. In addition, the haptic feedback obtained in accordance with an embodiment of the invention during establishment/release of the snap-fit connection arrangement can prevent accidental manual release of the connection and also premature release in the event of intentional or unintentional loading of the connection.

Moreover, the groove strip and the tongue strip can be arranged via the respectively provided attachment regions on any component that, at least in its edge region, provides an attachment surface corresponding to the attachment region. In this respect, the snap-fit connection arrangement according to an embodiment of the invention is suitable and usable for components that, at least in an edge region thereof, have a suitably formed front or top side or back or underside, respectively. This preferably includes all components already mentioned at the outset. Since the inventive snap-fit connection arrangement can be manufactured and marketed separately from the components to be connected, suitable standard components can be used and connected. An embodiment of the invention thus simplifies the manufacture of such components because no connecting means needs to be provided during the manufacture thereof. The user can freely choose the components he or she wants to connect using the approach of the invention. Thus, the advantages of embodiments of the invention are not limited to individual components or component groups, but are also applicable to combinations of different components or component groups.

In addition, due to the above-mentioned alignability of the components with respect to one another, the installation and alignment of components connected in accordance with embodiments of the invention can be performed with ease even after the snap-fit connection is established, and the components can still be aligned even after the connection is established. For example, windshields and/or other vehicle window panes as well as sunroofs could first be snapped onto the vehicle body and only then be aligned without the possibility of the already established connection accidentally becoming loose. Furthermore, the longitudinal direction of the strips may also serve as a reference line during alignment. Depending on the sizing of the inventive components (e.g., groove width, tongue width, etc.), it is also possible to specify gap dimensions. The worker can concentrate on the precise manipulation of the components, while the inventive snap-fit connection arrangement automatically fixes the components preliminarily in the desired position. This fixing in place is largely independent of position, so that depending on the occurring forces and the dimensions of the latching elements, overhead mounting may also be possible, both for creating surfaces that lie in a common plane and for creating surfaces that lie in intersecting planes. The snap-fit connection arrangement according to an embodiment of the invention thus makes it possible to form, by means of the component surfaces, edge and/or corner regions where the component surfaces may be disposed at an angle with respect to each other.

The attachment regions may also be intended for placement of component surfaces that are not flat, such as components with round contours. For this purpose, it would be possible to provide suitably shaped adapter elements whose contours correspond on the one hand to the contours of the attachment regions and on the other hand to the contours of the components. The attachment regions may have provided thereon a fastening means for attachment of a component, the fastening means being, for example, a hook-and-loop fastener strip, an adhesive tape, or the like.

Particularly preferably, the attachment regions are in the form of, preferably flat, contact surfaces in order to provide a support surface, in particular for planar elements. The advantages of embodiments of the invention are useful particularly in the case of planar elements, because the special design of the snap-fit connection arrangement makes it possible to produce surfaces and claddings for building constructions and structural bodies from a plurality of planar elements.

In a particularly preferred embodiment of the approach of the invention, there is further provided a latching recess that extends along and within the tongue and is prepared for latching engagement with the rib of a rib strip (i.e., with a third strip having a rib) and which is accessible in the joining direction as viewed from a plan view. In this way, the tongue is configured to have a (e.g., U-shaped or V-shaped) cross section having two opposite tongue legs between which the rib can be disposed. The material of the tongue strip may advantageously be selected such that the two tongue legs have spring properties, so that they are capable of yielding at least transversely to the joining direction and transversely to the longitudinal direction as the rib is inserted into the latching recess. This resilience causes the tongue legs to initially spread apart as the connection between the rib and the latching recess is established, and to substantially return to their initial position due to their elasticity after the connection is established (i.e., after the rib and the latching recess latchingly engage with one another) and when the insertion depth required for latching engagement is reached.

The term "joining direction" as used in this description refers to a first direction according to which the tongue of the tongue strip is to be inserted into the groove of the groove strip in order to bring about the latching engagement according to an embodiment of the invention.

When inserting the rib into the latching recess of the tongue, the latching recess may subsequently be at least partially filled with the material of the rib in order to inhibit the flexibility of the two legs in at least one direction of movement. The rib, which can be clamped between the tongue legs, can brace the two tongue legs relative to each other and act as a cross member that stiffens the cross section of the tongue transversely to the joining direction and at the same time transversely to the longitudinal direction. The advantage of this is that the behavior of the tongue's cross section can be influenced by the rib.

A preferred embodiment of the inventive snap-fit connection arrangement includes a, preferably single-piece, rib strip having a rib and preferably having a strip top member. The rib top member may be connected to the rib, the cross-sectional contours of the rib and the latching recess of the tongue being configured to correspond to each other through the use of latching elements so that the rib, or at least a portion or portions thereof, can be latchingly engaged with the latching recess. Particularly preferably, the rib top member extends over and above the latching recess, for example as a grip portion, and may preferably also rest on the attachment region. As explained further above, the rib braces or spreads the tongue legs, thereby protecting the latching engagement between the groove and the tongue from being manually and/or accidentally released. Ideally, the arrangement is designed such that the latching engagement between the groove and the tongue can only be released without damage after the rib strip has been removed. Preferably, it is provided that the force required to release the rib from the latching recess be many times higher than the force required to insert the rib into the tongue.

In combination with the rib strip, an embodiment of the invention provides an advantageous solution which combines the advantages of substantially non-releasable connections and those of releasable connections in the context of assembly and/or disassembly of components. The rib top member advantageously also functions as a cover for the latching recess of the tongue and/or a gap that may be present between the two components after the snap-fit connection is established. The rib top member possibly protruding from the latching recess may also perform additional functions and may preferably include means for, preferably detachable, mounting of an electrical component (e.g., an LED strip, sensors such as rain sensors, or the like) and/or may preferably include a conductor for supplying power to a load and/or for transmitting signals. Also, the rib may be electrified and include a conductor. Advantageously, the rib top member may additionally be implemented as a gap seal, for example, to meet ingress protection (IP) class requirements. For example, protection against spray water in accordance with the IP classification (e.g., IP 65) may be implemented where necessary.

Particularly preferably, the aforedescribed rib strip is at least partially pivotably connected to the tongue strip or to the groove strip, preferably at the transition between the groove or tongue and the attachment region. This connection may preferably be produced integrally and simultaneously with the strips in a (co-)extrusion process, for example, so that the connection behaves in accordance with the properties of a hinge for pivotably connecting to the rib strip to the groove strip or for pivotably connecting to the rib strip to the tongue strip. The arrangement is dimensioned such that the rib is manually insertable into the latching recess by means of the pivoting movement. This prevents, for example, the rib strip from being lost during assembly operations. This embodiment of the invention is also advantageous when working on slopes or at vertical mounting locations.

Advantageously, provision is made for the force required to release the latching engagement between the latching recess and the rib to be many times higher than the force required to establish the latching engagement. This increases the reliability of the connection, as it can be assumed that the connection is substantially prevented from being released due to external influences which typically occur during assembly. This also has a positive effect on the haptic feedback.

In a preferred embodiment, the longitudinal extent of the tongue strip may be a multiple of the longitudinal extent of the groove strip, it being preferred that a plurality of groove strips be provided along the longitudinal extent of the tongue strip and that preferably at least one rib strip be provided that can be latchingly engaged with the latching recess of the tongue strip. In this case, it is also possible that a plurality of components may be provided on the plurality of groove strips. For example, a supporting beam could be attached to the attachment region of the single tongue strip, the attachment regions of the plurality of groove strips having disposed thereon a plurality of laths which are to be aligned perpendicular to the supporting beam and to be attached to the supporting beam. In this way, for example, roofing battens could be disposed on, aligned with, and fixed to the rafters of a roofing framework without tools.

In an alternative embodiment, the longitudinal extent of the groove strip may be a multiple of the longitudinal extent of the tongue strip, it being preferred that a plurality of tongue strips be provided along the longitudinal extent of the groove strip and that preferably at least one rib strip be provided that can be latchingly engaged with the latching recesses of the tongue strips. It is now possible to easily implement a similar construction as in the previous example, where the supporting beam may now be equipped with only the single groove strip, and where the laths may be connected to the plurality of tongue strips.

In a possible embodiment of the invention, the snap-fit connection arrangement includes at least one component. In this variant, this component and the tongue and/or this component and the groove are preferably formed as a single piece, so that the attachment region between the tongue or groove and the component is implemented by means of the peripheral portion of the component. This variant recommends itself for application-specific designs that require integral components, which may be manufactured in an extrusion process, for example.

In general, it should be noted that the many times greater force required to release the connection, as explained further above, is understood to be a clearly measurable difference in force that exceeds the usual tolerances of the materials and measuring equipment used. The snap-fit arrangement according to an embodiment of the invention is dimensioned and designed such that the difference between the force required to manually establish the connection and that required to manually release it is haptically clearly perceptible to a worker. Preferably, this is also understood to mean that the releasing of the connection requires at least twice as much force compared to the establishing of the connection. Ideally, the latching elements are dimensioned such that the establishing of the connection is associated with a clearly audible snap sound, while the releasing of the connection produces less noise. In addition, the seating and/or snapping of the rib strip onto the groove strip may serve as an audible indication of a locked connection.

A component according to an embodiment of the invention includes at least one groove strip as described above and/or at least one tongue strip as described above. Ideally, the component can be produced as a single piece and preferably by an extrusion process using a suitable extrusion die. In this case, the attachment region of the groove strip and/or tongue strip is implemented by means of a peripheral portion of the component (e.g., a portion of the component's contour) along which the groove and/or the tongue are/is disposed outside the contours of the component. For this purpose, an extrusion die that is preferably used is provided with openings whose contours are configured to correspond to the groove cross section and/or to correspond to the tongue cross section. Such a component has the advantage that it can be connected without tools to a preferably substantially identical second component that also includes such a groove strip and/or tongue strip. The two components may then be aligned relative to each other in the longitudinal direction and may preferably additionally be fixed in place by means of the rib strip subsequent to alignment, so that the structural body can be produced with high stability.

An embodiment of the invention further includes an assembly method, the advantages of which are evident from the previous explanations.

It is understood that the features mentioned hereinbefore and the features in the drawings to be commented on hereinafter may be used not only in the specified combinations, but also in other combinations not explicitly specified here or alone or in isolation without departing from the scope of the present invention. This applies particularly to all features which are shown and/or described in the various embodiments merely for the sake of completeness, but are not essential to the invention; i.e., those which are not absolutely necessary to achieve the effects of the invention.

Embodiments of the invention are hereinafter illustrated only in rough schematic form in the drawings on the basis of the following exemplary embodiments and briefly described with reference to the drawings. Functionally equivalent components and/or features of the snap-fit connection arrangement according to embodiments of the invention are provided with the same reference numerals, and so reference is made to the description of the figures in which a component and/or a feature was first explained.

The term "joining direction A" as used in this description refers to a first direction according to which tongue 201 of tongue strip 200 is to be inserted into groove 301 of groove strip 300 in order to bring about the latching engagement according to an embodiment of the invention. The term "transverse direction B" as used in this description describes a second direction that is transverse, i.e., substantially perpendicular, to joining direction A. Joining direction A and transverse direction B define a first plane which corresponds to the planes of the sheets of the figures that show sectional views of inventive arrangements. All sectional views of strips 100, 200, 300 lie in these planes of the drawing sheets. The term "longitudinal direction C" refers to a third direction that is transverse, i.e., substantially perpendicular or 90 degrees, to joining direction A and at the same time also transverse, i.e., substantially perpendicular or 90 degrees, to transverse direction B. Joining direction A and longitudinal direction C define a second plane which is perpendicular to the planes of the sheets of the figures that show sectional views of inventive arrangements. This plane is also referred to as the joining plane.

The term "longitudinal extent" as used in this description describes a lengthwise dimension in longitudinal direction C (length) that can actually be measured on strips 100, 200, 300, and the term "transverse extent" as used in this description describes a lengthwise dimension in transverse direction B (width) that can actually be measured on strips 100, 200, 300. If the extent of strips 100, 200, 300 in longitudinal direction C and the extent of strips 100, 200, 300 in transverse direction B are approximately identical, then the arrangement is a spot-type arrangement. In this case, the length or width may correspond to a strip diameter.

All of the following drawings show embodiments of the invention and applications only in rough schematic form. The presented selection of embodiments is not exhaustive and should be considered as being exemplary only.

FIG. 1 exemplarily and roughly schematically shows in cross section a plastic rib strip 100, which is preferably used to vertically secure the inventive snap-fit connection in joining direction A within the joining plane. Rib strip 100 includes a rib 102, which preferably has a rib top member 101 that is preferably integrally connected with rib 102. Rib top member 101 and/or rib 102 include(s) a top side and an underside, which are transverse to the joining plane, and respective opposite longitudinal sides perpendicular to the top and undersides, as well as two opposite face sides as viewed parallel to the plane of the drawing sheet. Rib 102 is preferably integrally connected with rib top member 101, which results in an approximately T-shaped rib strip cross section. Rib 102 may be disposed centrally or off-center below rib top member 101 when viewed in cross section.

The left longitudinal side and/or the right longitudinal side of rib 102 may each be provided with an undercut 105, which may be implemented, for example, by means of a groove 105 extending along the longitudinal sides. At the underside 106 of the rib, a material taper is provided in joining direction A. In the example, this is implemented by means of an acutely tapered end portion. This serves to facilitate the insertion of rib 102 into the opening of latching recess 205 of tongue 201, since the opening width of the latching recess 205 is substantially equal to the maximum cross-sectional width of rib 102 or is preferably implemented with a slightly reduced width as compared to the maximum cross-sectional width of rib 102, so that the legs at the two sides of latching recess 205 are spread apart as the rib 102 is inserted. Undercut 105, possibly in cooperation with additional latching elements preferably provided within latching recess 205, may also serve to influence the amount of force exerted during removal of rib 102 from latching recess 205 of tongue 201. However, the primary purpose of the undercut 105 in rib 102 is to latchingly engage with projections in the entrance region of latching recess 205, which are created by the undercut 207 at latching recess 205.

If present, a rib top member 101 may be provided, on its top surface, with a connecting means 104, for example for detachable mounting of an electrical load (not shown) on rib top member 101. Examples of suitable connecting means include a double-sided adhesive tape 104, a hook-and-loop fastener 104, or the like. Alternatively, the connecting means 104 provided may also be a mounting plate 104 by means of which electrical objects and/or non-electrical objects may be permanently or detachably mechanically disposed on rib top member 101. Preferably, rib strip 100 includes a means 103 for distributing power and/or signals, preferably an electrical conductor 103 and/or an OWG (e.g., a fiber-optic conductor) 103. Rib strip 100 may also perform additional functions such as providing a seal between components 203, 303 and/or providing illumination (e.g., an LED strip). In a variety of different specific applications, rib strip 100 may assume additional functions, such as the function of a baseboard molding strip in floor constructions.

Rib strip 100 may be produced as a continuous length by extrusion, it being preferred that the means 103 be continuously enclosed by the plastic material during extrusion until the desired lengthwise dimension of rib strip 100 has been produced. Rib strip 100 can then be severed from the continuous length. Connecting means 104 could also be disposed on the plastic material already during this manufacturing process. In this case, the plastic material of the strip and/or means 103 and/or connecting means 104 are preferably severed in a single operation.

Figure 2:
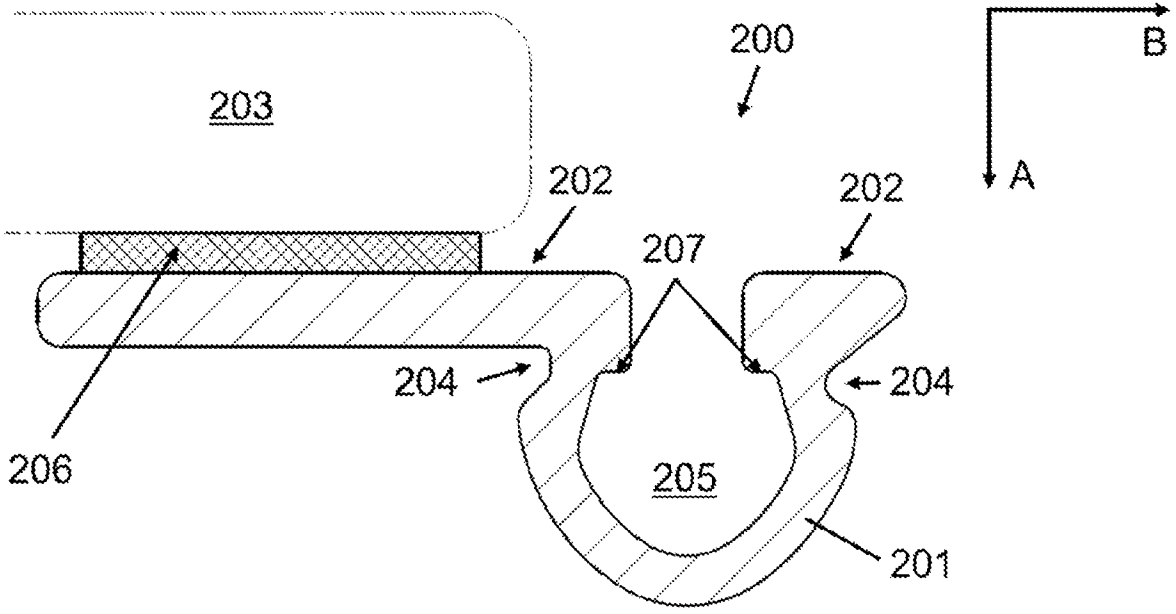
FIG. 2 is a cross-sectional view of a tongue strip made of plastic.

FIG. 2 roughly schematically shows a plastic tongue strip 200, which was preferably also produced by extrusion from an extruded continuous length. The preferably one-piece plastic tongue strip 200 includes a flat contact surface 202 provided on the left tongue leg, as shown in the figure by way of example, for placement of the tongue 201 along a peripheral portion of a component 203 (e.g., a metal plate, cover, cladding, or the like).

Tongue strip 200 may be disposed on the peripheral portion of component 203 by means of contact surface 202 in such a way that tongue 201 extends outside of, or immediately adjacent to, the contour of the component. A second contact surface 202, which is preferably reduced in width compared to first contact surface 202, may be provided on the right tongue leg, as shown in the figure by way of example. Preferably, the contact surfaces 202 extending along tongue 201 on the left and right sides thereof are substantially flat and lie in a common plane. Offset and intersecting planes would also be possible. The two contact surfaces 202, which preferably have different dimensions, could alternatively, of course, also be disposed in inverted positions on tongue 201.

Component 203 may be fixedly disposed on contact surface 202 by means of a connecting means 206 (e.g., an adhesive tape, a hook-and-loop fastener strip, an adhesive bead, and the like). In the region of the connection between tongue 201 and contact surfaces 202, the contour of the tongue cross section includes, on both sides, notches 204 which extend in longitudinal direction C and are intended to implement a snap-fit connection with corresponding projections 304 on the groove 301 of the plastic groove strip 300 presented below in connection with FIG. 3. At the end portion of the tongue, a material taper is provided in joining direction A. In the example, this is implemented by means of a slightly mushroom-shaped tongue cross section. This serves to reduce the amount of force exerted during insertion of tongue 201 into groove 301 of groove strip 300 and/or to temporarily spread the groove legs apart and/or to temporarily compress the tongue legs. During compression, the tongue legs move toward each other, and during spreading, the groove legs move away from each other. In this connection, it is preferred that the elasticity of the tongue legs be many times higher than the elasticity of the groove legs.

The tongue 201 shown includes a latching recess 205 intended to receive the rib 102 of rib strip 100, which is known from FIG. 1. For purposes of influencing the latching engagement between rib 102 and latching recess 205, undercuts 207 may be provided within latching recess 205 on both sides thereof, preferably in the region of contact surfaces 202, the undercuts 207 extending in longitudinal direction C.

Figure 3:
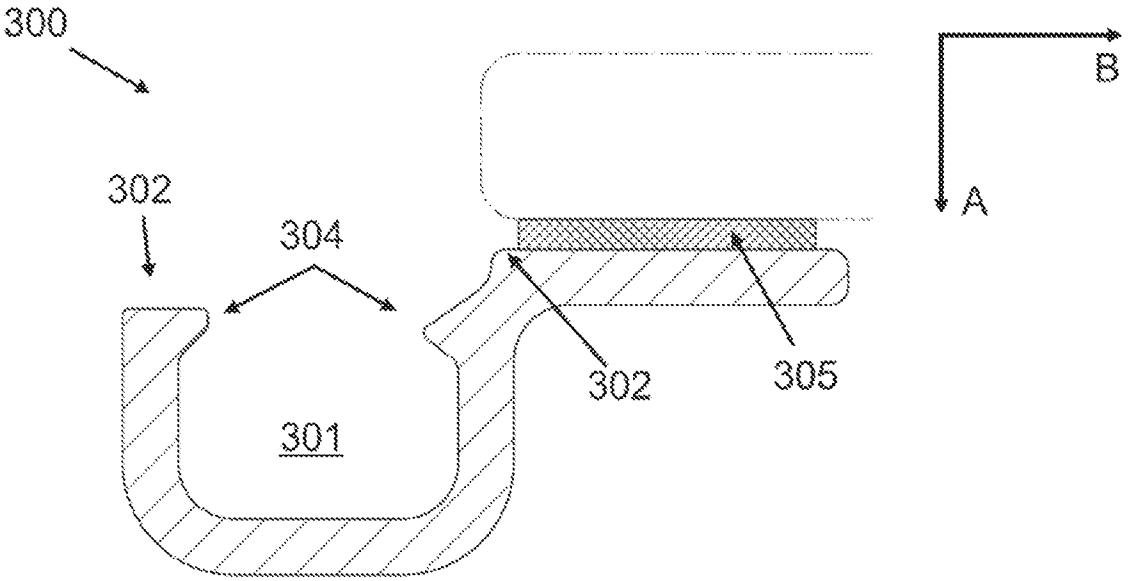
FIG. 3 is a cross-sectional view of a groove strip made of plastic.

FIG. 3 roughly schematically shows a plastic groove strip 300, which was preferably also produced by extrusion from an extruded continuous length. The one-piece plastic groove strip 300 includes a preferably flat contact surface 302 provided on the right groove leg, as shown in the figure by way of example, for placement of the groove 301 along a peripheral portion of a component 303 (e.g., a metal plate, cover, cladding, or the like).

Groove strip 300 may be disposed on the peripheral portion or contour portion of the component by means of contact surface 302 in such a way that groove 301 extends along one of the two outer sides or along the edge of the component and outside of, or immediately adjacent to, the contour of the component. A second contact surface 302, which is reduced in width compared to first contact surface 302, may be provided on the left groove leg, as shown in the figure by way of example. Preferably, the contact surfaces 302 extending along groove 301 on the left and right sides thereof lie in different planes. While the first contact surface 302 shown on the right in the figure is used for the placement of component 303, the second contact surface 302, which is shown on the left in the figure and is vertically offset with respect to first contact surface 302, serves as a support for the underside of the component-supporting contact surface 202 of the tongue strip 200 once the tongue 201 is in latching engagement with groove 301. Therefore, this second contact surface 302 of groove strip 300 is preferably disposed on groove strip 300 in such a way that after a snap-fit connection is established, at least the component-supporting contact surface 202 of tongue strip 200 and the component-supporting contact surface 302 of groove strip 300 lie substantially in a common plane, so that the underside of the component-supporting contact surface 202 of tongue strip 200 rests on the top side of the second contact surface 302 of groove strip 300. Component 303 may be fixedly disposed on one of the two contact surfaces 302 by means of a connecting means 305 (e.g., an adhesive tape, a hook-and-loop fastener strip, an adhesive bead, and the like).

Provided at the groove entrance on both sides thereof are projections 304, which, together with the notches 204 known from FIG. 3, may create a snap-fit connection once the groove 301 and the tongue 201 are joined together in direction A with a sufficient insertion depth. In order to catch tongue 201 during the establishment of the connection, the groove entrance may be chamfered at least on one side as viewed in joining direction A. Groove strip 300 is preferably implemented by an elastic material and/or a springy material or a suitable combination of materials, at least in the region of groove 301. This may serve to reduce the amount of force exerted during insertion of tongue 201 into groove 301. In order to facilitate the removal of tongue 201 from groove 301, a chamfer may also be provided underneath a projection 304 as viewed against joining direction A.

Figure 4:
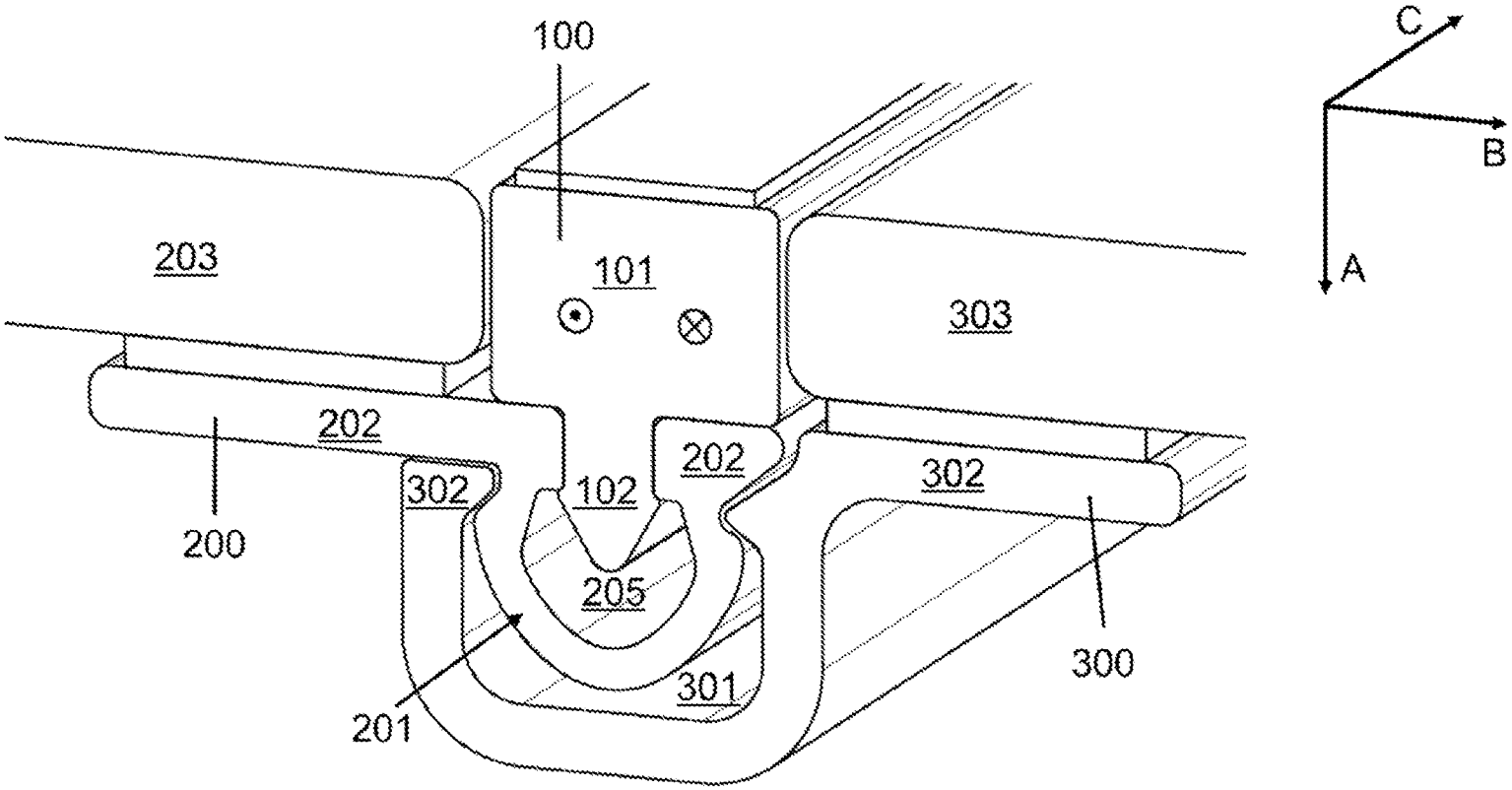
FIG. 4 is a perspective view of a snap-fit connection arrangement.

FIG. 4 roughly schematically shows in perspective view an already established and locked snap-fit connection arrangement including the snap-fit connection components 100, 200, 300 presented in connection with FIGS. 1 through 3. Therefore, reference is made to FIGS. 1 through 3 and the description associated therewith, and to the components already described using reference numerals. Shown is a perspective view, and therefore, longitudinal direction C, which indicates the longitudinal extent, can be seen here.

The snap-fit connection arrangement shown includes the one-piece plastic groove strip 300 with a first flat contact surface 302 for a first component 303 (shown on the right in the figure), the first contact surface 302 extending along groove 301. Preferably, a first component 303 is already disposed along groove 301 on contact surface 302. Further included is a one-piece plastic tongue strip 200 with a second flat contact surface 202 for a second component 203 (shown on the left in the figure), the second contact surface 202 extending along tongue 201. Preferably, a second component 203 is already disposed along tongue 201 on contact surface 202. Groove strip 300 and tongue strip 200 each extend in or parallel to longitudinal direction C.

The cross sections of tongue 201 and groove 301 are configured to correspond to each other by means of latching elements 204, 304 (see also FIGS. 2 and 3) so that a releasable snap-fit connection can be established between tongue 201 and groove 301. It can be clearly seen how the projections 304 on groove 301 engage with the notches 204 on tongue 201. Once the latching elements 204, 304 are in latched engagement, they also perform a guiding function so that tongue strip 200 remains variable and movable along its longitudinal extent with respect to groove strip 300, or vice versa, even after having been latched together. Movement transverse to longitudinal direction C; i.e., for example, in transverse direction B or against joining direction A, is inhibited and is only possible when the snap-fit connection between groove 301 and tongue 201 is released by exerting a clearly measurable amount of force. The overall arrangement is designed such that the contact surfaces 302, 202 of groove strip 300 and tongue strip 200, which are intended to support a component 203, 303, lie in a common plane or, alternatively, in two different planes that are parallel to or intersect each other. The contact surface 302 of groove strip 300 that is shown on the left in the figure below the component-supporting contact surface 202 of tongue strip 200 is intended to support the component-supporting contact surface 202 of the tongue strip 200 on the opposite side. Therefore, this contact surface 302 of groove strip 300, which is vertically offset with respect to the component-supporting contact surface 302 of groove strip 300, lies in a plane that is different from the plane of the component-supporting contact surface 302 and preferably extends substantially therebelow and/or parallel thereto.

Rib 102 is designed such that it can be interlockingly inserted into latching recess 205, preferably in the region of the opening thereof, while rib top member 101 bears against a contact surface 202 of tongue strip 200, preferably outside the latching recess 205. Rib 102 can thus close the entrance of latching recess 205, at least along a portion or portions thereof. Rib 102 is dimensioned such that after it is latchingly engaged with latching recess 205, it has a stiffening effect on the approximately annular-segment-shaped cross section of tongue 201 and thus braces the legs of the latching recess 205 relative to each other and preferably spreads them slightly apart. As a result, tongue 201 is fixed in place within groove 301 by clamping action. This clamping effect makes it difficult to remove tongue 201 manually from groove 301 and, depending on the occurring frictional forces, substantially inhibits relative displacement between groove strip 300 and tongue strip 200.

For the longitudinal extent of strips 100, 200, 300, it preferably holds that:

$$\frac{\text{longitudinal extent}}{\text{transverse extent}} \gg 1$$

Ultimately, however, this ratio depends on the particular application and can be freely configured or controlled, for example, in an extrusion process, and in some instances also in a fully automated manner and preferably in an application-specific manner.

Figure 5:
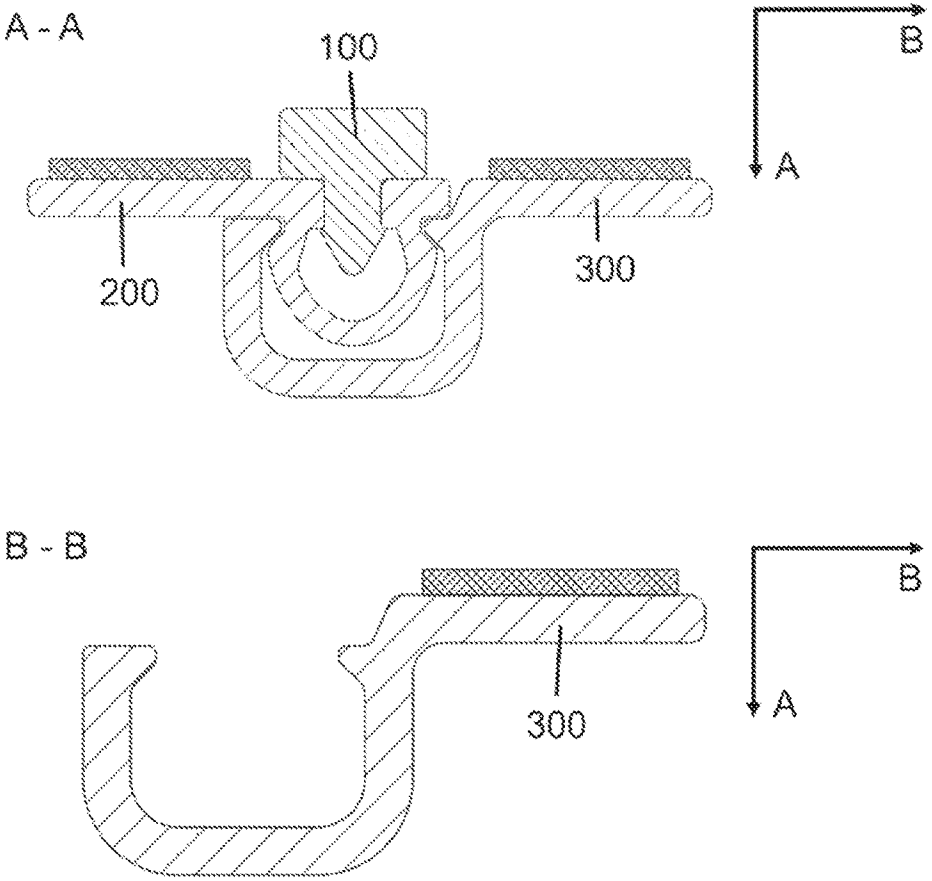
FIG. 5 is a view of a first snap-fit connection variant having a continuous groove strip.
Figure 5:
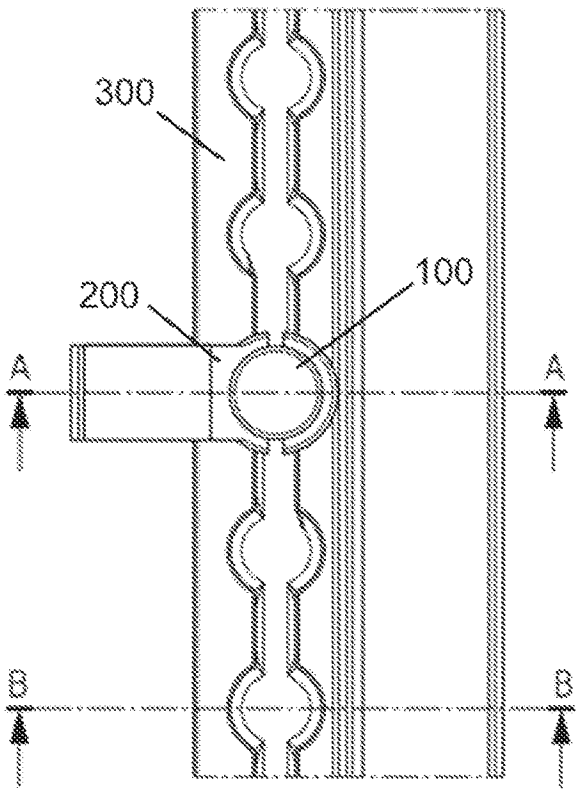

FIG. 5 shows, by way of example, a preferred alternative snap-fit connection arrangement 100, 200, 300 for implementing spot-type connections. Shown is a single groove strip 300 which is intended to receive tongue strips 200. For reasons of clarity, only one tongue strip 200 is shown in the figure. The longitudinal extent of groove strip 300 is a multiple of the longitudinal extent of a tongue strip 200. Preferably, a plurality of tongue strips 200 can be disposed along groove strip 300 in order to create a plurality of spot-type connections. In this exemplary embodiment, to enable tongue strip 200 to be preadjusted on groove strip 300, provision is made for openings which are preferably circular in shape and preferably uniformly distributed along the groove entrance of groove strip 300 when viewed in joining direction A (plan view). Accordingly, tongues 201 of tongue strip 200 have a corresponding contour, which in this example is therefore also circular in shape (but may alternatively be, for example, square and/or rectangular, star-shaped, or the like), so that a plurality of tongues 201 can be disposed within the openings, preferably in accordance with the uniform distribution. A number of rib strips 100 corresponding to the number of tongue strips 200 may be provided which can be latchingly engaged with the respective latching recesses 205 of the tongue strips 200 in order to secure the established connections. Depending on the shape of the contours, it is also possible to realize an angle different from 90 degrees between the transverse direction B of tongue strip 200 and the longitudinal direction C of the groove strip 300. Ultimately, the contour may also be configured as a latching contour, so that a variety of different predeterminable angles are adjustable between the longitudinal extent of groove strip 300 and the transverse extent of tongue strip 200. The accuracy of adjustment can be defined by the dimensioning of the latching contour.

Figure 6:
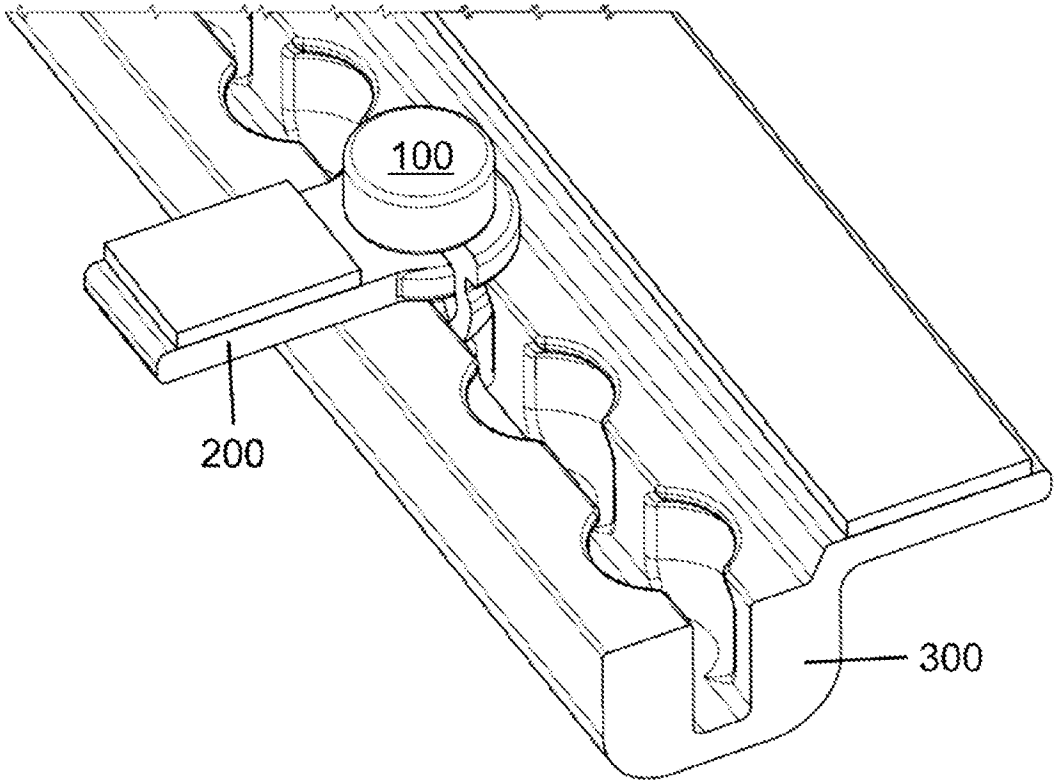
FIG. 6 is a perspective view of the design of FIG. 5.

The cross section of the spot-type arrangements in the section A-A shown is obtained by assembling the snap-fit connection components 100, 200, 300 shown in FIGS. 1 through 3 in accordance with an embodiment of the invention. The cross section of the spot-type arrangements in the section B-B shown results from the snap-fit connection component 300 (groove strip) shown in FIG. 3. At this point, reference is made to the description of the respective figures. FIG. 6 shows the arrangement of FIG. 5 in a perspective view.

Figure 7:
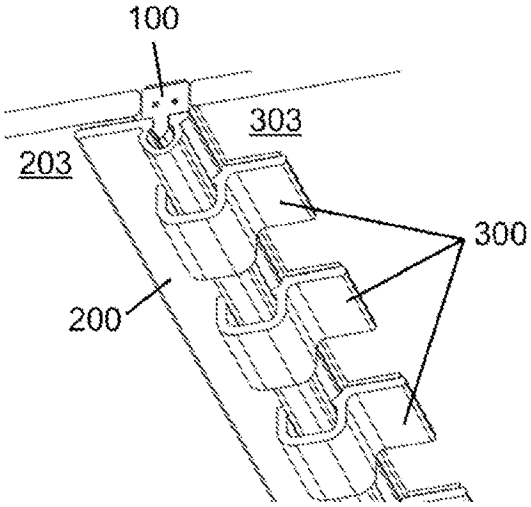
FIG. 7 is a view of a second snap-fit connection variant having a continuous tongue strip.
Figure 7:
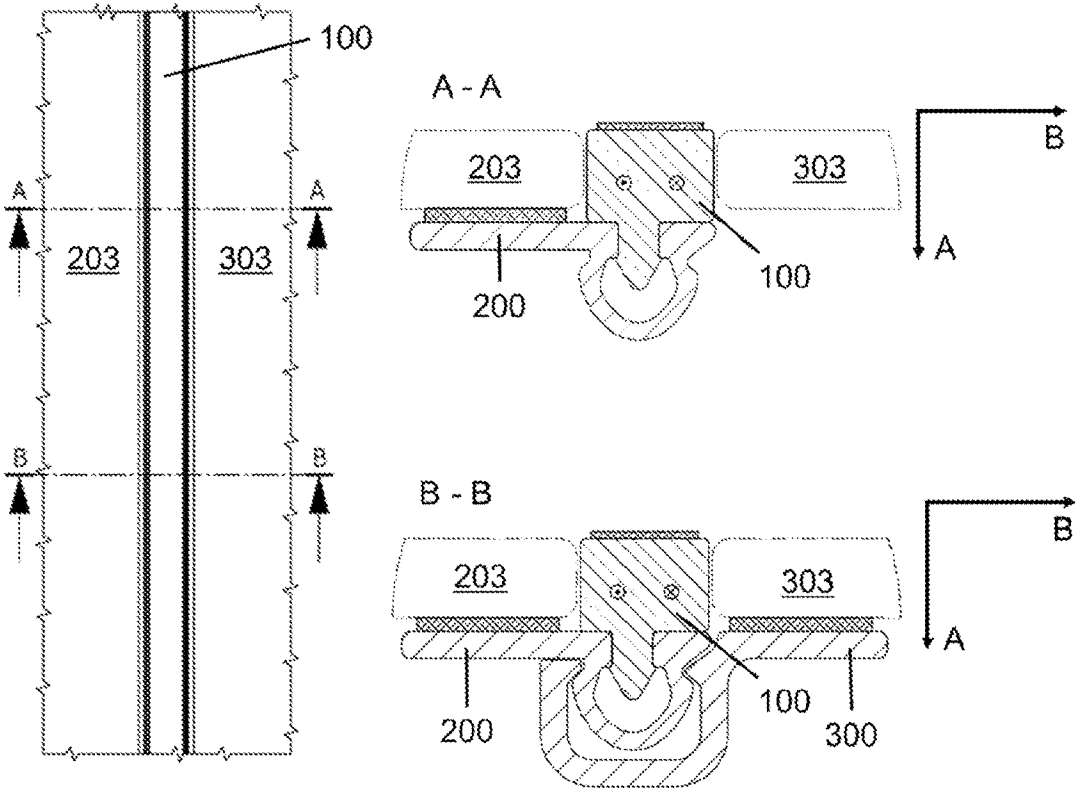

FIG. 7 shows, by way of example, a preferred alternative snap-fit connection arrangement 100, 200, 300 for implementing spot-type connections. The upper left quadrant of the figure shows, in top view, a portion of the arrangement according to an embodiment of the invention, including components 203, 303 and a continuous rib strip 100. In this view, only the preferably flush surface of components 203, 303 and rib strip 100 is visible. The upper right quadrant of the figure shows a detail of this portion of the arrangement in a bottom view depicting the aforementioned rib strip 100, a single continuous tongue strip 200, and a plurality of groove strips 300. Tongue strip 200 serves here to receive a plurality of groove strips 300. The longitudinal extent of tongue strip 200 is a multiple of the longitudinal extent of a groove strip 300. In order to create a plurality of spot-type connections, a plurality of groove strips 300 are disposed along tongue strip 200. In this exemplary embodiment, the individual grooves 301 are disposed along the continuous tongue 201, preferably in a uniformly distributed manner. A plurality of rib strips 100 corresponding to the number of groove strips 300 may be provided which are latchingly engaged with latching recess 205 at every position of tongue 201 where tongue 201 is inserted into a groove 301.

In the variant of FIG. 5, it is also possible to replace the plurality of individual rib strips 100 by a single continuous rib strip 100 (not shown), which may then extend continuously over all spot-type connections. In the variant of FIG. 7, there could also be provided individual rib strips 100, ideally for securing the respective individual spot-type connections.

Figure 8:
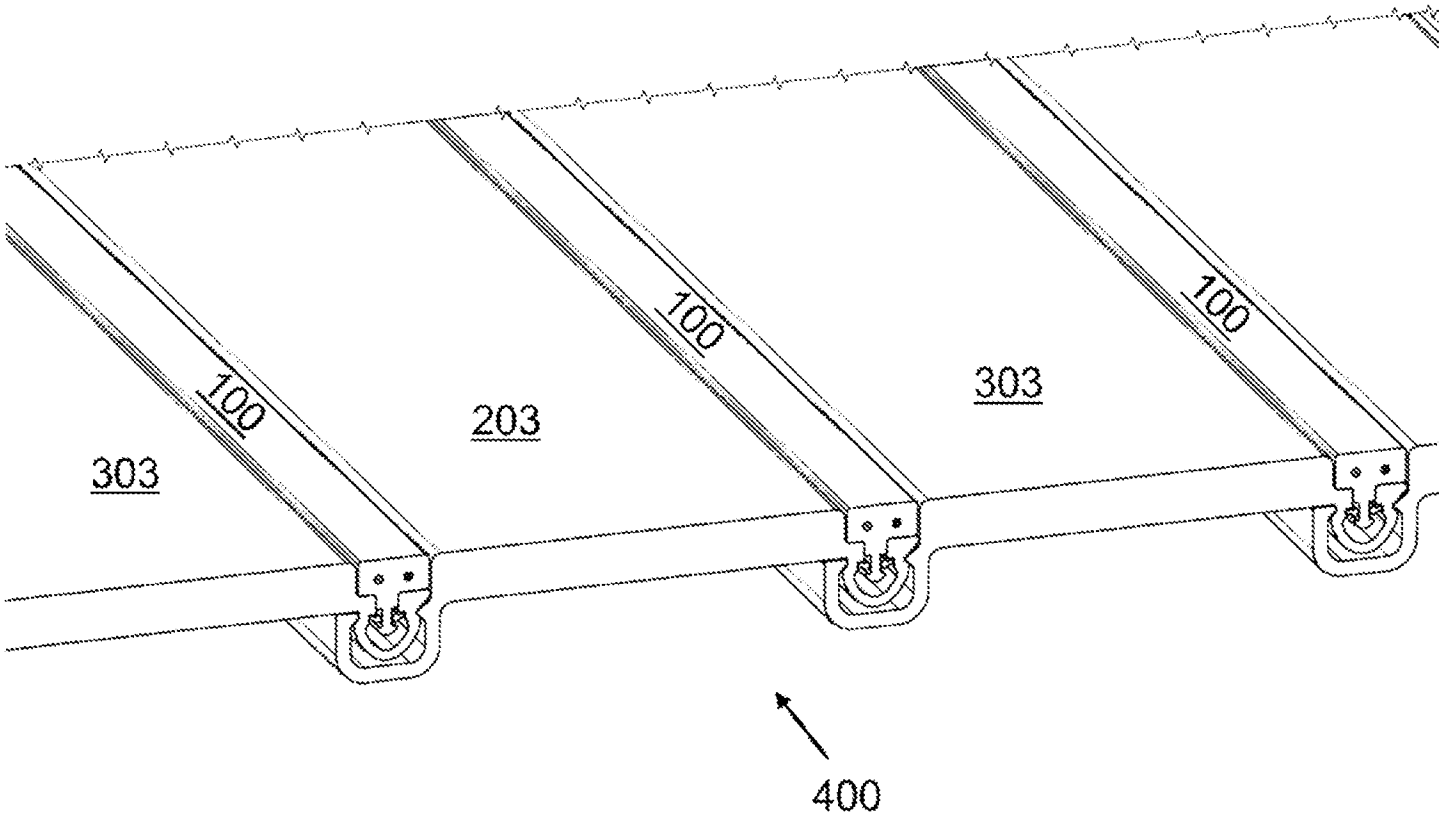
FIG. 8 is a perspective view of an application of the snap-fit connection arrangement.
Figure 9:
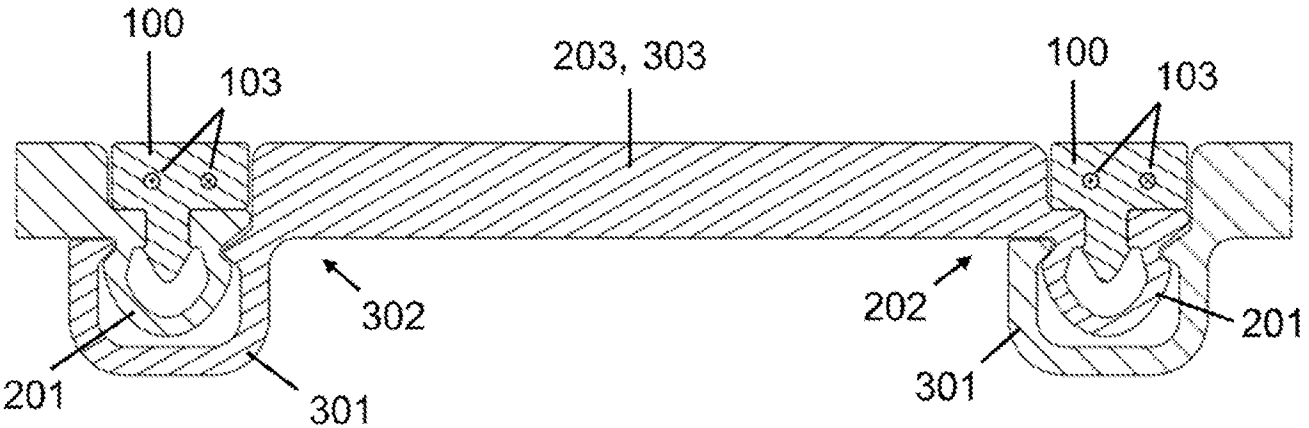
FIG. 9 is a sectional view of a portion of the design of FIG. 8.

FIG. 8 shows an inventive first component 203, 303 in a composite assembly 400 with other inventive components 203, 303, and FIG. 9 illustrates the cross section of this arrangement. The inventive component 203, 303, here in the form of a planar element, has a top side, an underside, a left outer side, a right outer side, and two end faces. The arrangement could be, for example, a floor construction 400 or a wall construction 400, such as a privacy screen 400 for properties, or a wall cladding 400.

The groove 301 of a plastic groove strip 300 is disposed along a first contour portion or peripheral portion of component 203, 303 (e.g., left outer side, FIG. 9). The tongue 201 of a plastic tongue strip 200 is disposed along a second, preferably opposite contour portion or peripheral portion of component 203, 303 (e.g., right outer side, FIG. 9). In the case of a one-piece arrangement, as shown here, the respective contour portions or peripheral portions of the component at the same time form the attachment regions 202, 302 by which groove 301 and tongue 201 are respectively disposed on component 203, 303.

The cross sections of tongue 201 and groove 301 are configured to correspond to each other by means of latching elements 304, 204 so that a snap-fit connection can be established, for example, between a tongue 201 of a first component 203 and groove 301 of a second component 303. The connection concept is designed such that the two components 203 and 303 can still be manually moved relative to each other even after the snap-fit connection between groove 301 and tongues 201 is established. Thus, components 203, 303 remain adjustable in the longitudinal direction of strips 200, 300. However, movement in a direction different from the longitudinal direction is made more difficult. The attachment regions 202, 302 (only schematically indicated in FIG. 9) of the respective strips 200, 300 latchingly engaged with one another lie in a common plane, which makes it possible to produce large and preferably flat surfaces using a plurality of component arrangements according to an embodiment of the invention. Depending on the design of the attachment regions 202, 302, it is also conceivable to dispose components 203, 303 at an angle to each other in order to form, for example, corner regions of a structural body. In this case, attachment regions 202, 302 are disposed at an angle to each other and within intersecting planes (not shown). Attachment regions 202, 302 are located at least partially within the contours of components 203, 303, while groove 301 and tongue 201 are located outside the contours of components 203, 303. Due to the illustrated unitary design, attachment regions 202, 302 of strips 200, 300 merge with the depicted peripheral portions of the components 203, 303. As a further result of the unitary design, the transitions between strips 200, 300 and components 203, 303 are smooth, and the attachment regions 202, 302 of strips 200, 300 are no longer clearly identifiable as isolated attachment regions on the component, as would be the case with a multi-piece solution. Preferably, such a one-piece component 203, 303 is extruded as a continuous length from plastic material by means of an extrusion process. An electrification 103 of rib strip 100 could also be beneficial in such applications, for example, to supply power to loads on such surfaces.

Figure 10:
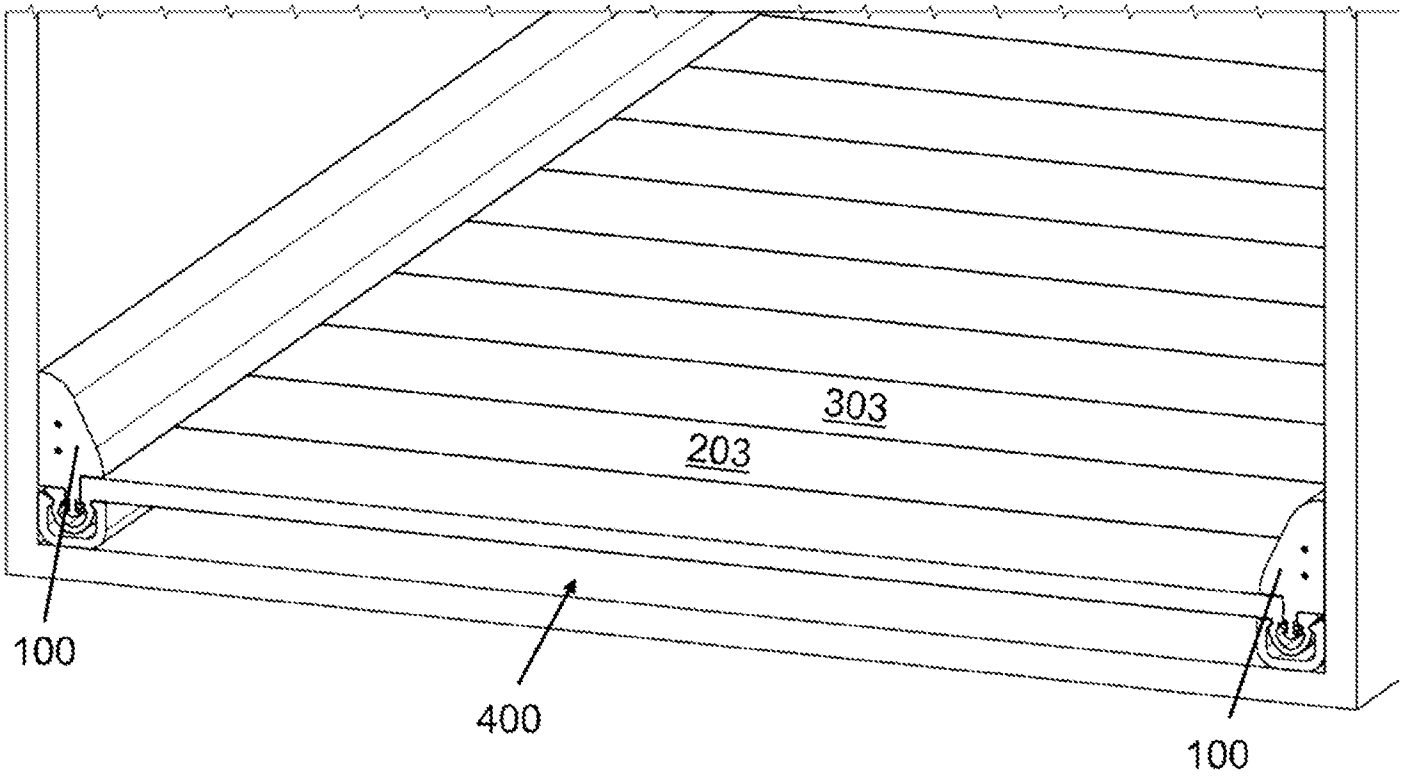
FIG. 10 is a perspective view of another application of the snap-fit connection arrangement.
Figure 11:
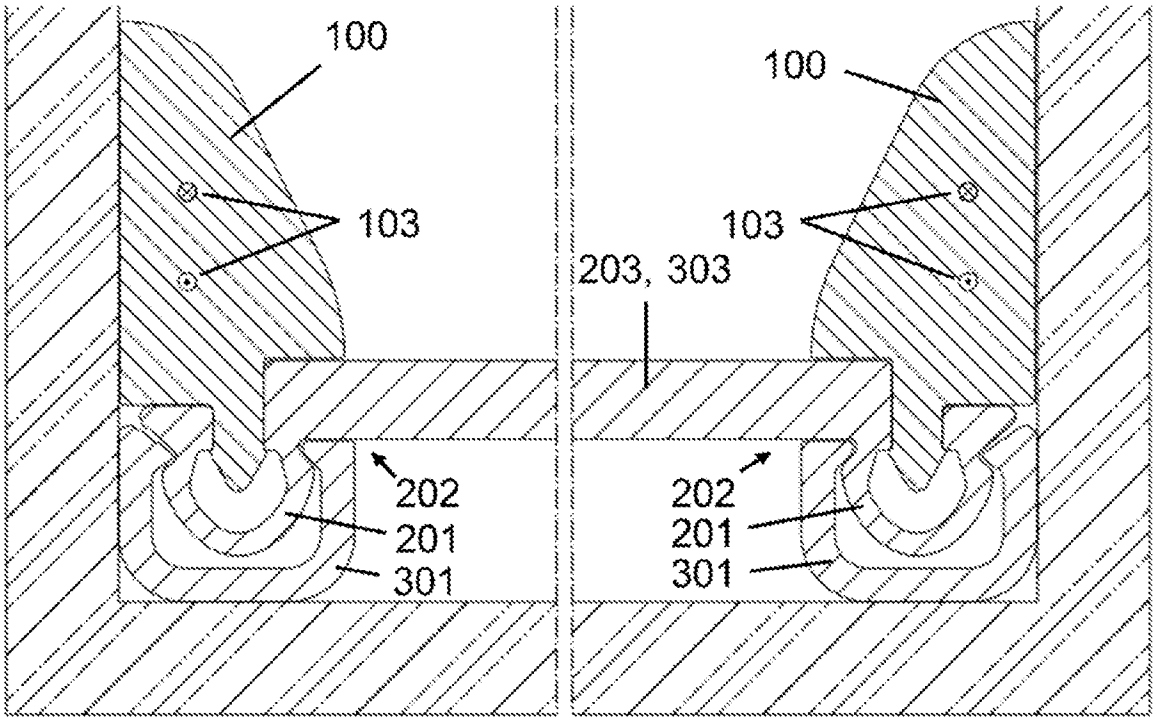
FIG. 11 is a sectional view of the design of FIG. 10.

FIG. 10 shows a composite assembly of components 400 including snap-fit connection arrangements, which include at least one component 203, 303. FIG. 11 shows the cross section of this arrangement. In the figure, a component 203, 303 is formed in one piece with a tongue strip 200. Alternatively, component 203, 303 could also be formed in one piece with a groove strip 300 (not shown). In either case, the attachment region 202, 302 of the respective strip 200, 300 is implemented by the peripheral portion of component 203, 303 and as such is part of the overall arrangement. Here, too, the transitions of components 200 and 203, 303 and 300 and 203, 303, respectively, are smooth due to the preferred unitary design. Preferably, this one-piece component 203, 303 is also produced as a continuous length by extrusion of plastic material. Since the composite assembly of components 400 shown here is a floor construction 400, rib strip 100 functions also as a preferably electrified 103 baseboard molding strip 100. When using a modified rib strip 100, the composite assembly of components 400 could alternatively also function as a privacy screen element 400, for example in the garden area. In either case, rib strip 100 performs several functions simultaneously. On the one hand, it is used to secure the inventive snap-fit connection arrangement 200, 300. In the example here, it additionally performs an application-specific function. Furthermore, it may be used to transmit power or signals, such as electrical power and/or electrical signals. The latter applies to all applications shown. As an alternative to extrusion, all of the components shown in FIGS. 1 through 11 may also be produced by injection molding or 3D printing. It is recommended to use the assembly method in particular for the exemplary applications shown beginning with FIG. 4, as it facilitates assembly and allows for rapid and cost-effective construction.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

A joining direction
B transverse direction
C longitudinal direction
100 rib strip
101 rib top member
102 rib
103 conductor
104 hook-and-loop fastener strip, adhesive tape
105 latching element (e.g., undercut)
106 underside of the rib in joining direction A
200 tongue strip
201 tongue
202 attachment region or contact surface
203 component

204 latching element (e.g., notch)
205 latching recess
206 connecting means
207 latching element (e.g., undercut)
300 groove strip
301 groove
302 attachment region or contact surface
303 component
304 latching element (e.g., projection)
305 adhesive agent
400 structural body

The invention claimed is:

1. A snap-fit connection arrangement comprising:

a groove strip having a groove and a first attachment region extending along the groove for placement of the groove along a first component, the groove strip extending in a first longitudinal direction transversely to a cross section of the groove strip, a tongue strip having a tongue and a second attachment region extending along the tongue for placement of the tongue along a second component, the tongue strip extending in a second longitudinal direction transversely to a cross section of the tongue strip, and a rib strip having a rib, wherein cross-sectional contours of the tongue and the groove correspond to each other through use of latching elements so that a snap-fit connection can be established between the tongue and the groove as the tongue is inserted in a joining direction into the groove, the snap-fit connection allowing for relative movement between the tongue strip and the groove strip along at least one of the longitudinal directions and preventing relative movement between the tongue strip and the groove strip transversely to at least one of the longitudinal directions, wherein the first and second attachment regions lie in a common plane or in two different planes that intersect each other, wherein the tongue includes a latching recess that extends along and within the tongue, the latching recess comprising an undercut and being configured for latching engagement with the rib of the rib strip, and wherein cross-sectional contours of the rib and the latching recess of the tongue correspond to each other through use of further latching elements so that a further snap-fit connection can be established between the rib and the latching recess of the tongue by the rib elastically deforming the latching recess as the rib is inserted into the latching recess until the rib latchingly engages with the undercut of the latching recess.

2. The snap-fit connection arrangement as recited in claim 1, wherein at least one of the attachment regions is configured as a contact surface.

3. The snap-fit connection arrangement as recited in claim 2, wherein the contact surface is flat.

4. The snap-fit connection arrangement as recited in claim 1, wherein the latching recess of the tongue is accessible in the joining direction as viewed from a plan view.

5. The snap-fit connection arrangement as recited in claim 1, wherein the rib strip is at least partially pivotably connected to the tongue strip or pivotably to the groove strip so that the rib is insertable into the latching recess of the tongue by a pivoting movement.

6. The snap-fit connection arrangement as recited in claim 1, wherein the snap-fit connection arrangement is configured such that a force required to release the latching engagement between the latching recess and the rib is multiple times higher than a force required to establish the latching engagement between the latching recess and the rib.

7. The snap-fit connection arrangement as recited in claim 1, wherein the rib strip is electrified and/or includes means for mounting of an electrical load.

8. The snap-fit connection arrangement as recited in claim 7, wherein the means for mounting of the electrical load are means for detachable mounting of the electrical load.

9. The snap-fit connection arrangement as recited in claim 1, wherein the snap-fit connection arrangement is configured such that a force required to release the latching engagement between the tongue and the groove is multiple times higher than a force required to establish the latching engagement between the tongue and the groove.

10. The snap-fit connection arrangement as recited in claim 1, wherein an extent of the tongue strip in the second longitudinal direction is a multiple of an extent of the groove strip in the first longitudinal direction.

11. The snap-fit connection arrangement as recited in claim 10, wherein the groove strip, or multiple ones of the groove strip, is/are provided along the second longitudinal direction of the tongue strip.

12. The snap-fit connection arrangement as recited in claim 1, wherein an extent of the groove strip in the first longitudinal direction is a multiple of an extent of the tongue strip in the second longitudinal direction.

13. The snap-fit connection arrangement as recited in claim 12, wherein the tongue strip, or multiple ones of the tongue strip, is are provided along the first longitudinal direction of the groove strip.

14. The snap-fit connection arrangement as recited in claim 1, wherein the first and/or second attachment region(s) include(s) a fastener configured to attach a component to the first and/or second attachment region(s).

15. The snap-fit connection arrangement as recited in claim 1, further comprising at least one component, wherein the at least one component and the tongue and/or the at least one component and the groove are formed in one piece, so that the first and/or second attachment region(s) is/are implemented by a peripheral portion of the at least one component.

16. The snap-fit connection arrangement as recited in claim 1, wherein the first and second longitudinal directions are the same.

17. The snap-fit connection arrangement as recited in claim 1, wherein the rib strip further comprises a rib top member connected to the rib.

18. The snap-fit connection arrangement as recited in claim 1, wherein at least one of the latching elements has a barb-like shape.

19. The snap-fit connection arrangement as recited in claim 1, wherein the snap-fit connection requires a greater force to release than to establish and fixes the groove strip and the tongue strip in place in a direction opposite to the joining direction.

20. The snap-fit connection arrangement as recited in claim 1, wherein the snap-fit connection arrangement is configured such that a force required to release the latching engagement between the tongue and the groove, when the rib is in latching engagement with the latching recess, is multiple times higher than a force required to establish the latching engagement between the tongue and the groove when the rib is not received in the latching recess.

21. A component comprising:

a component contour, a groove strip having a groove and a first attachment region which extends along the groove and by which the groove strip is disposed along a first contour portion of the component contour so that the groove extends along the first contour portion in a first longitudinal direction transversely to a cross section of the groove strip, a tongue strip having a tongue and a second attachment region which extends along the tongue and by which the tongue strip is disposed along a second contour portion of the component contour so that the tongue extends along the second contour portion of the component in a second longitudinal direction transversely to a cross section of the tongue strip, and a rib strip having a rib, wherein cross-sectional contours of the tongue and the groove correspond to each other through use of latching elements so that a snap-fit connection can be established between the tongue and the groove as the tongue is inserted in a joining direction into the groove, the snap-fit connection allowing for relative movement between the tongue strip and the groove strip along at least one of the longitudinal directions and preventing relative movement between the tongue strip and the groove strip transversely to at least one of the longitudinal directions, wherein the first and second attachment regions lie in a common plane or in two different planes that intersect each other, wherein the tongue includes a latching recess that extends along and within the tongue, the latching recess comprising an undercut and being configured for latching engagement with the rib strip of the rib, and wherein cross-sectional contours of the rib and the latching recess of the tongue correspond to each other through use of further latching elements so that a further snap-fit connection can be established between the rib and the latching recess of the tongue by the rib elastically deforming the latching recess as the rib is inserted into the latching recess until the rib latchingly engages with the undercut of the latching recess.

22. The component as recited in claim 21, wherein the latching recess of the tongue is accessible in the joining direction as viewed from a plan view.

23. The component as recited in claim 21, wherein the component and the tongue strip and/or the component and the groove strip are formed in one piece, so that the first and/or second attachment region(s) is/are implemented by a peripheral portion of the component.

24. A structural body comprising at least a first and a second one of the component according to claim 21, wherein the groove of the first component is in latching engagement with the tongue of the second component.

25. The snap-fit connection arrangement as recited in claim 21, wherein the rib strip further comprises a rib top member connected to the rib.

26. An assembly method using the snap-fit connection arrangement according to claim 1, the assembly method comprising:

establishing the snap-fit connection by inserting the tongue into the groove in the joining direction, and inserting the rib of the rib strip into the latching recess of the tongue so that the further snap-fit connection is established between the rib and the latching recess of the tongue.

27. A snap-fit connection arrangement comprising:

a groove strip having a groove and a first attachment region extending along the groove for placement of the groove along a first component, the groove strip extending in a first longitudinal direction transversely to a cross section of the groove strip, and a tongue strip having a tongue and a second attachment region extending along the tongue for placement of the tongue along a second component, the tongue strip extending in a second longitudinal direction transversely to a cross section of the tongue strip, wherein cross-sectional contours of the tongue and the groove correspond to each other through use of latching elements so that a snap-fit connection can be established between the tongue and the groove as the tongue is inserted in a joining direction into the groove, the snap-fit connection allowing for relative movement between the tongue strip and the groove strip along at least one of the longitudinal directions and preventing relative movement between the tongue strip and the groove strip transversely to at least one of the longitudinal directions, the latching elements including opposing projections of the groove facing in opposing directions that are automatically received within opposing notches of the tongue upon the tongue reaching a predetermined insertion depth into the groove to form the snap-fit connection, wherein the first and second attachment regions lie in a common plane or in two different planes that intersect each other, and wherein the tongue includes a latching recess defined between two opposite tongue legs, the latching recess extending along and within the tongue and being configured for latching engagement with.

28. The snap-fit connection arrangement as recited in claim 27, further comprising the rib strip having the rib, wherein cross-sectional contours of the rib and the latching recess of the tongue correspond to each other through use of further latching elements so that a further snap-fit connection can be established between the rib and the latching recess of the tongue by the rib being inserted between and elastically deforming the two opposite tongue legs of the latching recess of the tongue as the rib is inserted into the latching recess until the rib latchingly engages between the two opposite tongue legs and closes an entrance of the latching recess, the rib being dimensioned such that, after latchingly engaging between the two opposite tongue legs of the latching recess, the rib has a stiffening effect that braces the two opposite tongue legs of the latching recess relative to each other and thereby provides a clamping effect inhibiting removal of the tongue from the groove.

29. The snap-fit connection arrangement as recited in claim 27, wherein the groove and the tongue are each U-shaped.

30. A snap-fit connection arrangement comprising:

a groove strip having a groove and a first attachment region extending along the groove for placement of the groove along a first component, the groove strip extending in a first longitudinal direction transversely to a cross section of the groove strip, and a tongue strip having a tongue and a second attachment region extending along the tongue for placement of the tongue along a second component, the tongue strip extending in a second longitudinal direction transversely to a cross section of the tongue strip, wherein cross-sectional contours of the tongue and the groove correspond to each other through use of latching elements so that a snap-fit connection can be established between the tongue and the groove as the tongue is inserted in a joining direction into the groove, the snap-fit connection allowing for relative movement between the tongue strip and the groove strip along at least one of the longitudinal directions and preventing relative movement between the tongue strip and the groove strip transversely to at least one of the longitudinal directions, wherein the first and second attachment regions lie in a common plane or in two different planes that intersect each other, and wherein the tongue includes a latching recess that extends along and within the tongue, the latching recess comprising an undercut and being configured for latching engagement with a rib of a rib strip, and wherein the snap-fit connection arrangement is configured such that a force required to release the latching engagement between the tongue and the groove is multiple times higher than a force required to establish the latching engagement between the tongue and the groove.

31. The snap-fit connection arrangement as recited in claim 30, further comprising the rib strip having the rib, the rib being received in the latching recess and being dimensioned so as to configure the snap-fit connection arrangement such that the force required to release the latching engagement between the tongue and the groove is multiple times higher than the force required to establish the latching engagement between the tongue and the groove when the rib is not received in the latching recess.

* * * * *